US006889013B2

(12) United States Patent
Chapman et al.

(10) Patent No.: US 6,889,013 B2
(45) Date of Patent: May 3, 2005

(54) OPTIMIZING A PRINTING MOTOR UNDER VARYING TORQUE LOADS

(75) Inventors: Danny Keith Chapman, Nicholasville, KY (US); Steven Michael Turney, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 17 days.

(21) Appl. No.: 10/457,859

(22) Filed: Jun. 10, 2003

(65) Prior Publication Data

US 2004/0253008 A1 Dec. 16, 2004

(51) Int. Cl.[7] ..... G03G 15/00
(52) U.S. Cl. ..... 399/13
(58) Field of Search ..... 399/13, 53, 222, 399/223, 228, 58

(56) References Cited

U.S. PATENT DOCUMENTS 4,733,144 A 3/1988 Bisseling
4,916,490 A * 4/1990 Tanaka et al. ..... 399/223
RE33,500 E 12/1990 Bisseling
5,276,479 A * 1/1994 Inomata
5,384,526 A 1/1995 Bennett
5,737,483 A 4/1998 Inaji et al.
6,363,228 B1 3/2002 Ream
6,371,471 B1 4/2002 Fukazu et al.
6,470,157 B2 10/2002 Taneko

FOREIGN PATENT DOCUMENTS

JP 09211984 A * 8/1997 ..... G03G/15/08

* cited by examiner

*Primary Examiner*—Ryan M. Gleitz
(74) *Attorney, Agent, or Firm*—Coats & Bennett, PLLC

(57) ABSTRACT

In an electrophotographic print mechanism wherein one motor drives two or more removable toner cartridges, the presence of each cartridge is sensed and reported to the motor controller. If one or more cartridges are removed, such as for single-color printing, the motor control equation parameters are altered to compensate for the altered static torque load experienced by the motor. The parameters may be the proportional, integral, and/or derivative gains for one or more PID controllers.

18 Claims, 6 Drawing Sheets

OPTIMIZING A PRINTING MOTOR UNDER VARYING TORQUE LOADS

BACKGROUND

The present invention relates generally to the field of electrophotographic print machines, and in particular to a system and method of optimizing a motor drive system for changes in motor torque load such as that caused by single-color printing.

A variety of devices utilize electrophotographic print mechanisms to produce color image output, including printers, copiers, and multifunction machines that may include scan, copy, print, and fax operations in an integrated unit. Typically, the print mechanisms of such devices deposit and fuse four colors of toner—Cyan (C), Magenta (M), Yellow (Y), and Black (K)—onto a variety of media sheets to produce the color image output. Each color of toner is typically supplied in a removable cartridge, which includes a reservoir of toner, a photoconductive (PC) drum for selectively depositing the toner on a media sheet in response to a latent image produced by a laser, and various rollers and mechanisms for transferring the toner to, and depositing it on, the PC drum. The operation of electrophotographic print machines and toner cartridges are well known in the art. The toner transfer mechanisms and the PC drum of a toner cartridge are typically driven by a motor and associated drive train. Often, a motor may drive two or more toner cartridges. In one configuration, two motors may be utilized to drive four cartridges, i.e., one motor drives, e.g., the C and Y toner cartridges, and another motor drives the Y and K toner cartridges.

Color printing usually requires the use of at least the C, M, and Y toner colors, and often all four (CMYK). Black-only printing may be performed by use of only the K toner, or alternatively, by use of the C, M, and Y toner colors mixed together to produce black, a method known in the art as "process black." In either case, the unused toner cartridge(s) may be removed. In this case, the motor driving the Y and K toner cartridges will experience only half of its nominal torque load (as it drives only one of two expected toner cartridges).

The motors in electrophotographic print mechanisms must be precisely controlled as to speed and position, to achieve high levels of accuracy in placing toner on media sheets, known in the art as dot resolution. To achieve this accuracy, sophisticated motor controller systems have been developed. In many cases, the parameters and variables of the motor control systems are carefully tailored, or "tuned," to the actual anticipated motor operating conditions in a particular print mechanism implementation, including the expected motor torque load. When the torque load experienced by a motor is altered, such as by removal of one of the toner cartridges that the motor normally drives, it may alter the accuracy of speed and/or position control of the motor, thus degrading achievable dot resolution.

SUMMARY

The present invention relates to a print mechanism including at least two removable toner cartridges and a motor driving the two toner cartridges. The print mechanism includes at least one detector operative to detect whether each toner cartridge is inserted into the printer, and a motor controller operative to drive the motor in one of two modes in response to detecting whether one, or more than one, toner cartridges are inserted into the printer.

DETAILED DESCRIPTION OF THE INVENTION

Figure 1:
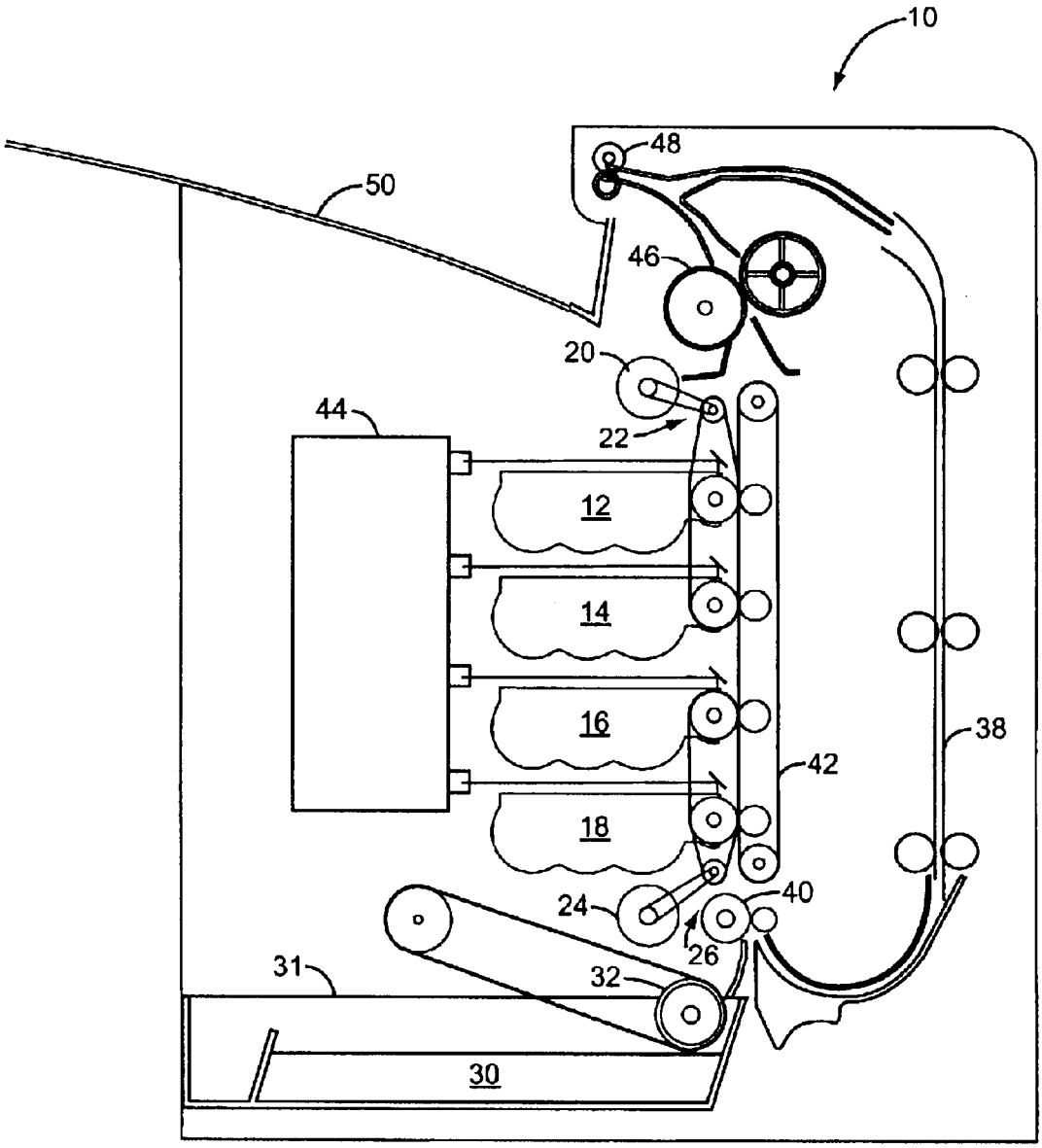
FIG. 1 is a sectional block diagram of an electrophotographic print mechanism.

FIG. 1 depicts an electrophotographic print mechanism, as embodied in a color laser printer, indicated generally by 10. A printer 10 is depicted for the purposes of explication of the present invention; the print mechanism may alternatively be embodied in a color copier, a multifunction device integrating scan, copy, print, fax, and similar operations, or the like, and fall within the scope of the present invention. Printer 10 includes four color toner cartridges: Cyan (C) 12, Magenta (M) 14, Yellow (Y) 16, and Black (K) 18. The C and M toner cartridges 12 and 14 are driven, in this embodiment, by a first motor 20 and drive train 22. The Y and K toner cartridges 16 and 18 are driven by a second motor 24 and drive train 26. Other arrangements of drive motors and toner cartridges may be utilized within the scope of the present invention.

The operation of laser printer 10 is conventionally known. A single media sheet is "picked," or selected, from a primary media stack 30 in a removable tray 31 by pick roller 32. Alternatively, a media sheet may travel through the duplex path 38 for a two-sided print operation. In either case, the media sheet is presented at registration roller 40, which aligns the sheet and precisely controls its further movement into the print path. The media sheet passes the registration roller 40 and electrostatically adheres to transport belt 42, which carries the media sheet successively past the four toner cartridges 18, 16, 14 and 12. At each toner cartridge 12, 14, 16, 18, a latent image is formed by printhead 44 onto the respective photoconductive (PC) drum in each toner cartridge 12, 14, 16, 18. Toner is applied to the PC drum, which is subsequently deposited on the media sheet as it is conveyed past the toner cartridges 12, 14, 16, 18 by the transport belt 42. The toner is thermally fused to the media sheet by the fuser 46, and then it passes through reversible exit rollers 48, to land face-down in the output stack 50 (alternatively, the exit rollers 48 may reverse motion after the trailing edge of the media sheet has passed the entrance to the duplex path 38, directing the media sheet through the duplex path 38 for the printing of another image on the back side thereof).

For single-color printing, such as black only, it is common to remove the C, M, and Y toner cartridges 12, 14 and 16, leaving only the K toner cartridge 18. Alternatively, if process black printing is performed, the K toner cartridge 18 may be removed, leaving only the C, M, and Y toner cartridges 12, 14 and 16. In either case, the second motor 24 experiences only half of its anticipated torque load. That is, the motor 24 will drive either K toner cartridge 18 alone, or Y toner cartridge 16 alone.

Due to the high drive power requirements of toner cartridges 12, 14, 16, 18, motors 20 and 24 are often of the brushless DC motor type. These motors are typically modeled analytically using methods similar to those used for brush DC motors. The models are used in turn to design control equations with various techniques such as Bode design, root locus design, and other design tools known in the art of control engineering. The models rely upon motor system parameters such as constant torque, constant back EMF, winding resistance, inertia, and the like. Traditional modeling techniques assume that these parameters are constant and independent of static torque load. However, empirical testing demonstrates that these parameters are sensitive to static load variations, particularly in outer-rotor brushless DC motors, such as the type used for motors 20 and 24.

The transfer function commonly used in controls engineering to model a DC type motor is $$\frac{\omega(s)}{V(s)} = \frac{K_t}{(sL+R)(sJ+D)+K_eK_t} \tag{1}$$

where $\omega$=Motor Speed;

V=Winding Voltage;

$K_e$=Back EMF Constant;

$K_t$=Torque Constant;

R=Winding Resistance;

L=Winding Inductance;

J=Motor Inertia; and

D=Damping Term.

This equation is used to design and set the dynamics of the control equations. If all of the right-hand side parameters are constant, then the relationship of motor speed to winding voltage is constant. However, if any of the right-hand side parameters change, the relationship of motor speed to winding voltage will change as well, causing the motor system to react differently to the same control equation. In other words, the motor 20, 24 may accelerate faster for a given incremental change in voltage under different torque loads. This causes the motor 20, 24 to change its motion quality as a function of the torque load, and will therefore degrade dot resolution accuracy if not compensated.

Figure 2:
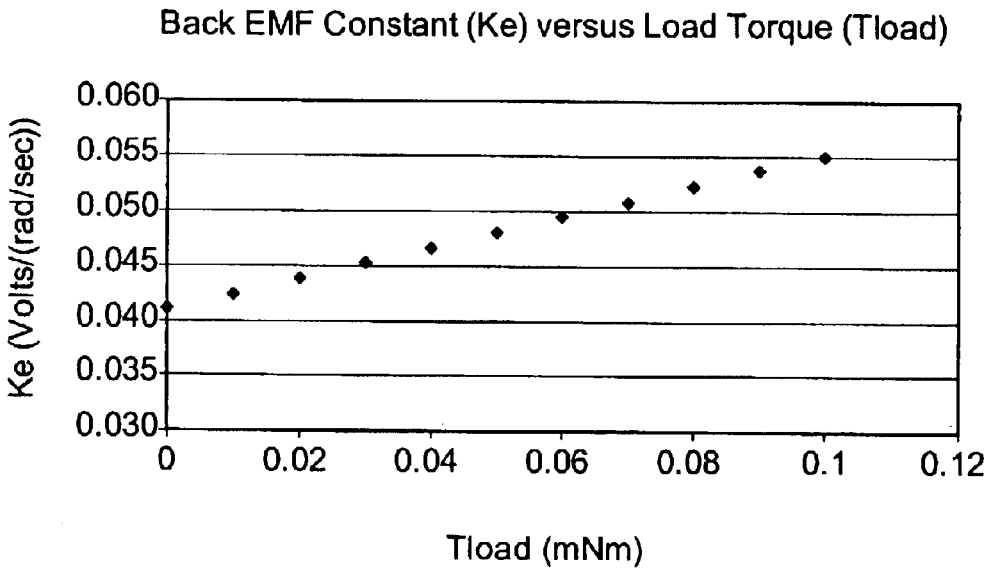
FIG. 2 is a plot of changing back-EMF constant vs. motor torque load.

As an example, FIG. 2 shows the values of measured back-EMF constant $K_e$ for a representative motor under different static torque load values, $T_{load}$. As FIG. 2 demonstrates, the value $K_e$ varies as $T_{load}$ changes. The back-EMF constant $K_e$ is merely one representative parameter of equation (1) above that demonstrably changes as a function of the static torque load. Other parameters may change with load as well.

As discussed above, precise speed and position control of DC motor 20, 24 is critical to high dot resolution in printer 10. One control system particularly well suited for printer control applications is disclosed in U.S. patent application Ser. No. 10/378,430, titled Motor Speed and Position Control, and filed Mar. 3, 2003, assigned to the assignee of the present invention, the disclosure of which is incorporated herein by reference in its entirety. Briefly, the control system comprises a "course" control loop that maintains constant speed, and a "fine" control loop that adjusts the constant speed loop to correct for accumulated errors in position. Each control loop may include a proportional, integral, derivative (PID) controller, with $K_p$, $K_i$, and $K_d$ control inputs, as well known in the art.

A test motor utilizing this control system was run under 100% load and 50% load (i.e., a torque load half that for which the control system parameters were set up), and the motion error was measured in each case. The proportional and integral control equation gains for the speed control loop, $K_{ps}$ and $K_{is}$, were varied and the positional error resulting from each equation is plotted in FIG. 3 for the case of 100% of anticipated torque load, and in FIG. 4 for the case of 50% load.

Figure 3:
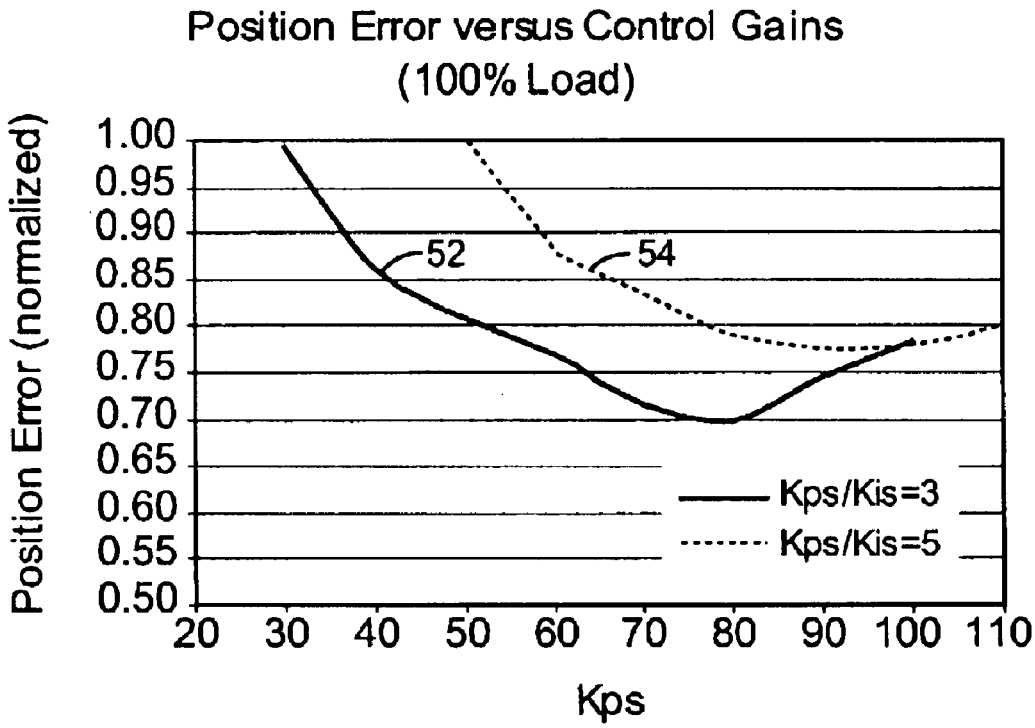
FIG. 3 is a graph of position error for two control gains at full torque load.
Figure 4:
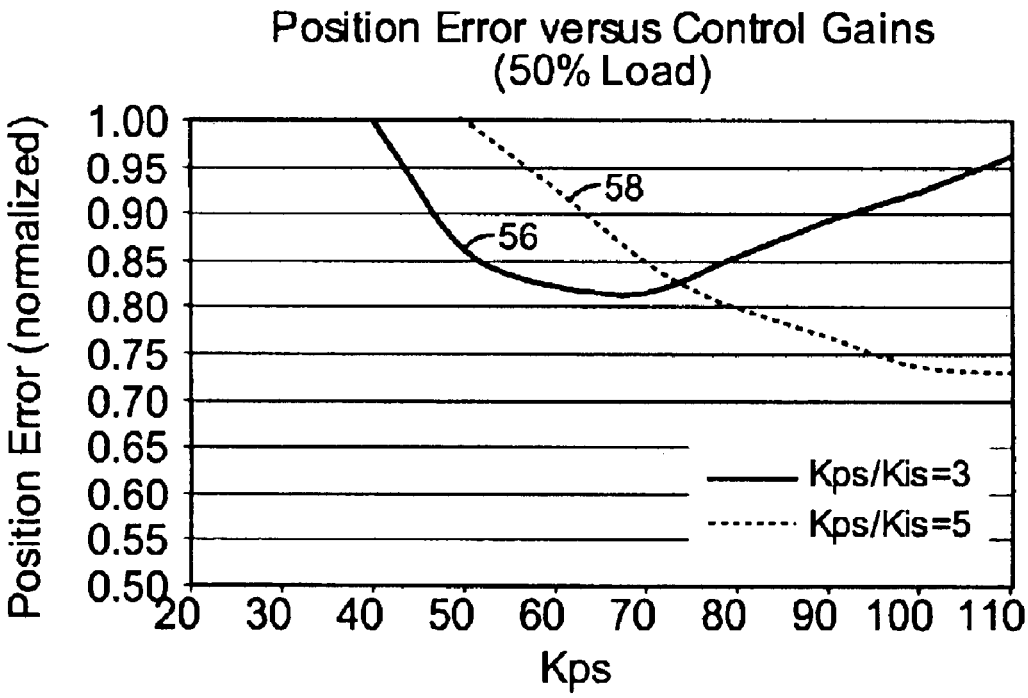
FIG. 4 is a graph of position error for two control gains at half torque load.

The solid curve 52 in FIG. 3 and the solid curve 56 in FIG. 4 represent the test cases in which the velocity proportional gain $K_{ps}$ and the velocity integral gain $K_{is}$ have a ratio of 3:1. The dashed curve 54 in FIG. 3 and the dashed curve 58 in FIG. 4 represent the cases in which the ratio is 5:1. The optimal operating point for the 100% load case (FIG. 3) is different than the optimal point for the 50% load case (FIG. 4), for a given $K_{ps}/K_{is}$ ratio. Not only do the optimal values of the control gains change in an absolute sense, but they additionally change relative to each other. Referring to FIG. 3, the 100% load case, the optimal control gains are such that $K_{ps}$ is about 78 and $K_{is}$ is one-third of $K_{ps}$ (these being the control values resulting in the least resulting position error). However, referring to FIG. 4 for the 50% load case, the optimal gains are such that $K_{ps}$ is about 110 and $K_{is}$ is one-fifth of $K_{ps}$. Thus, to maintain the minimum position error, the control system gain factors $K_{ps}$ and $K_{is}$ should be changed as the torque load on the motor 20, 24 changes from 100% to 50% of its anticipated value, such as would occur if one of two toner cartridges 16, 18 were removed from the printer 10 to effect single-color printing. This interplay of control system gain factors $K_{ps}$ and $K_{is}$ as the static torque load is changed is merely representative; similar curves could be constructed for other gains, ratios, and torque loads.

Figure 5:
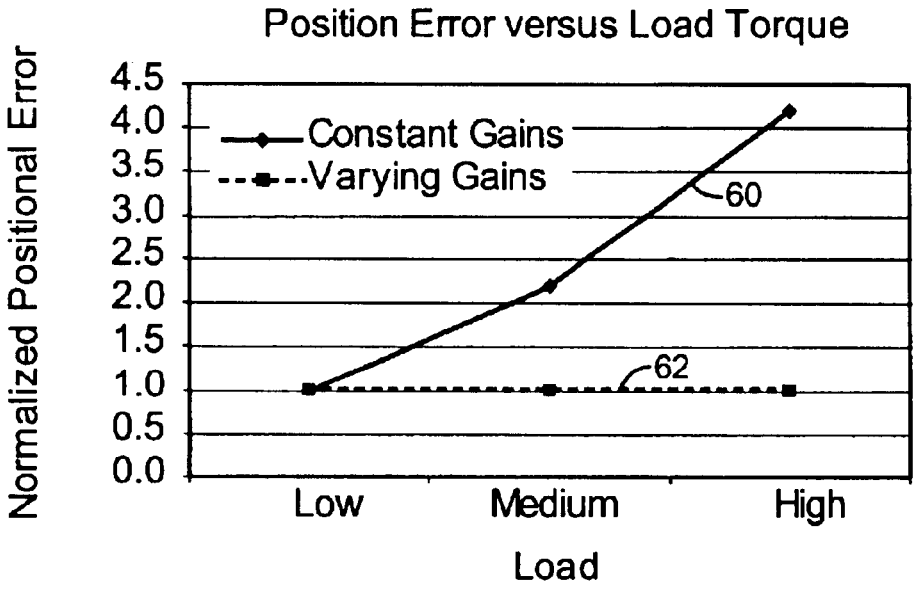
FIG. 5 is a graph of position error vs. torque load for constant and varying control gains.

FIG. 5 depicts the normalized position error of a brushless DC motor under varying torque loads in an EP printer 10. A test apparatus was constructed to empirically measure the motion variation of the motor 24 driving various static torque loads. The solid curve 60 shows the results of the tests when the control parameters were held constant; the dotted curve 62 shows the results of the tests when the control parameters were adjusted for the torque load changes. As FIG. 5 depicts, varying the control parameters appropriately produced a near-constant positional error independent of load, whereas a constant control equation produced various amounts of positional error as a function of load torque. These errors would create corresponding amounts of print defects in printer 10 for varying loads. That is, a printer 10 using a single motor 24 to drive both a black toner cartridge 18 and one or more color toner cartridges such as Y16, will have different levels of print quality for black-only images and color images if either the color toner cartridge(s) is removed for the black-only mode using only black toner, or the black toner cartridge is removed for the black-only mode using process black. This is a result of the change in motion quality caused by the change in control system dynamics. The control dynamics are affected by the change of motor parameters that are a function of the load torque (in this case, the cartridge loading).

To optimize print quality in all modes, motor controllers within the printer 10 need to sense the presence of the toner cartridges driven. When the controller determines that all toner cartridges are present, control parameters appropriate for the high load case are used to control the motors. If the controller determines that less than all toner cartridges are present, then control parameters for the appropriate torque load are used. Using this technique provides a consistent level of print quality that is independent of the number of cartridges being driven.

Figure 6:
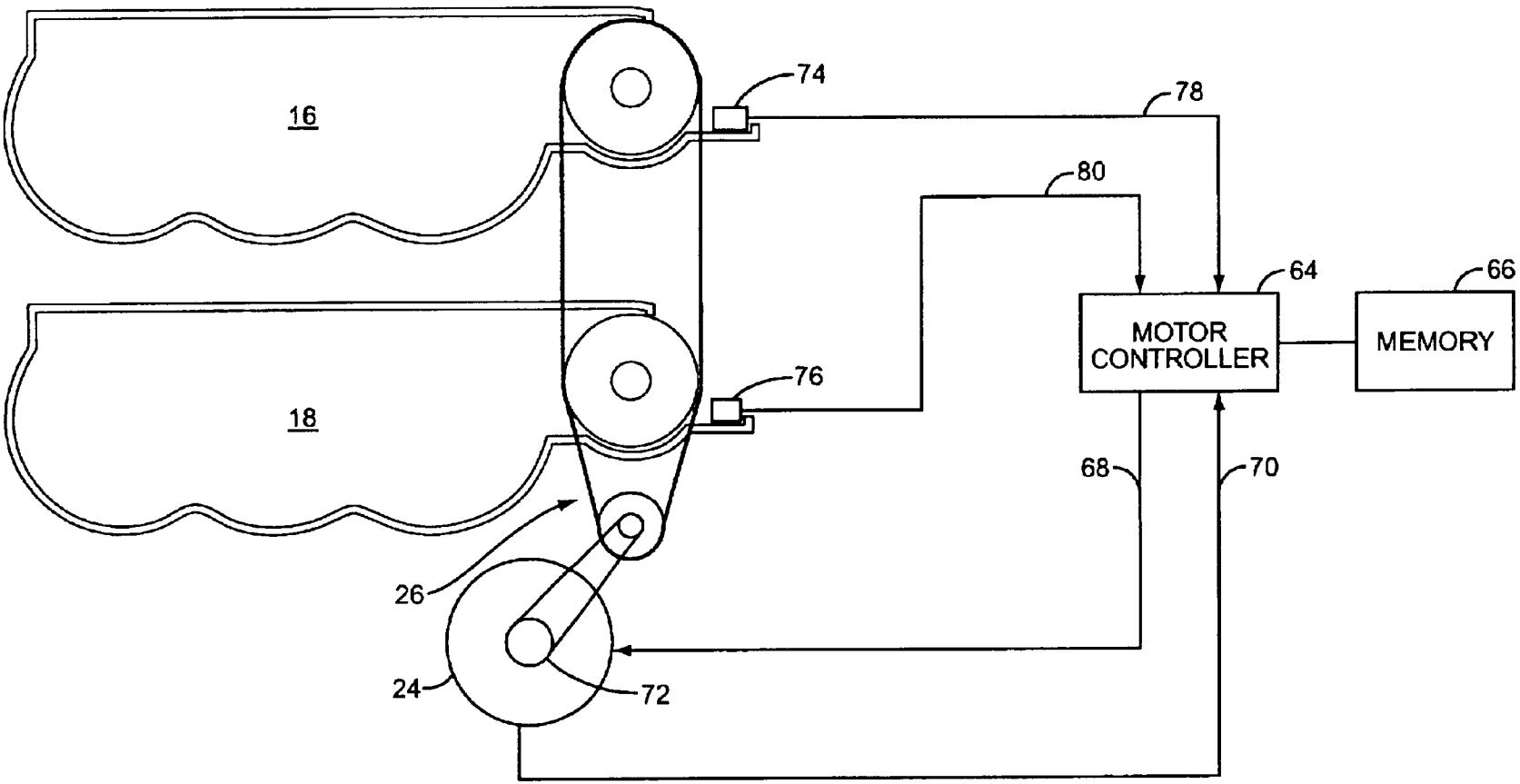
FIG. 6 is a functional block diagram of a motor control circuit.

FIG. 6 depicts a simplified block diagram of a motor control circuit for a representative motor 24 in the printer 10.

The control circuit comprises a motor controller 64, optional attached memory 66, a motor 24 and associated drive train 26, two or more toner cartridges 16,18, and toner cartridge sensors 74, 76. The motor 24, as described herein, may comprise a brushless DC motor. Attached to the shaft of the motor 24, or elsewhere in the motor drive train 26, is an encoder 72 that provides speed and position feedback from the motor 24 to the motor controller 64, along input line 70. The motor controller 64, preferably a precision speed and position controller as described herein, controls the motor 24 by varying voltages on one or more output lines 68, as well known in the art. The drive train 26 (note that the assembly of belts and gears depicted in FIG. 6 is a functional representation only) transfers force from the motor 24 to drive the PC drums and associated toner movement mechanisms of toner cartridges 16 and 18. The presence or absence of toner cartridges 16,18 is detected by sensors 74 and 76, respectively.

Sensors 74, 76 may be any of a broad variety of sensors known in the art, including, for example, simple electrical switch contacts that are opened or closed by a mating protrusion in the toner cartridge 16,18 housing. Alternatively, sensors 74, 76 may comprise ultrasonic, magnetic, optical, radio frequency, capacitive, or other proximity sensors, as are well known in the art. In one embodiment, the sensors 74, 76 may comprise cartridge sensors existing in the printer 10, such as smart chip sensors used to verify the make or configuration of the toner cartridge. Upon sensing the presence of toner cartridge 16, sensor 74 sends a "cartridge present" indicator along input 78 to the motor controller 64. Similarly, sensor 76 indicates the presence of toner cartridge 18 on input 80. Other toner cartridges driven by the same motor 24 are similarly detected by associated sensors, which relay the detected condition to the motor controller 64. Alternatively, information relating to the presence or absence of toner cartridges may be communicated to the motor controller 64 directly by the user, such as through the operator panel, or via an attached computer displaying a printer interface.

The motor controller 64 discovers the number of toner cartridges 16, 18 driven by the motor 24 that are actually present in the printer 10. Based on this information, the motor controller 64 determines the static torque load on the motor 24, and adjusts the motor control equation accordingly. In one embodiment, the motor controller 64 applies predetermined control parameters to one or more PID controllers to adjust the motor control equation. These predetermined parameters may be stored in memory 66, which may comprise any data storage medium known in the art, such as ROM, RAM, EEPROM, register files, or the like. Additionally or alternatively, the predetermined motor control parameters may be supplied by a programmed controller, such as a CPU or DSP in communication with the motor controller 64. As those of skill in the art will readily recognize, the entire motor controller 64 may be implemented as a software module on a CPU or DSP, and may comprise custom or semicustom circuits such as ASIC, FPGA, or the like. The functional block diagram of FIG. 6 is to be construed broadly.

Static torque loads experienced by the motor 24 may be predicted and compensated for by the motor controller 64 based on other data in addition to the number of the toner cartridges 16, 18 inserted into the printer 10. For example, information such as cartridge life, amount of toner remaining, temperature, and the like may be sensed and the data provided to the motor controller 64 for consideration. To the extent that, for example, new cartridges are known to exhibit a different torque load than older cartridges, or torque loads change based on the amount of toner remaining, temperature, or other factors, the motor controller 64 may retrieve appropriate motor control equation parameters from the memory 66, thus optimizing the motor drive system's performance, and ensuring the maximum possible dot registration resolution under all operating conditions.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. A print mechanism, comprising:

at least two removable toner cartridges;

a first motor driving said two toner cartridges;

a detector operative to detect whether each of said two toner cartridges is inserted into said print mechanism; and a motor controller operative to drive said motor in one of two modes in response to detecting whether one, or more than one, of said two toner cartridges are inserted into said Print mechanism;

wherein each of said two modes comprises a set of motor control parameters optimized to the torque load on said motor.

2. The print mechanism of claim 1 further comprising a second motor and including four removable toner cartridges, each of said four cartridges containing a different color toner, wherein said first motor drives two of said toner cartridges and said second motor drives the other two said toner cartridges.

3. The print mechanism of claim 3 wherein one of said four removable toner cartridges contains black toner, and wherein said black toner cartridge and one other cartridge are driven by said first motor.

4. The print mechanism of claim 3 wherein when only said black cartridge is inserted in said print mechanism said first motor drives only said black cartridge.

5. A method of driving a motor in an electrophotographic print mechanism, said motor driving a plurality of toner cartridges, comprising:

detecting a single-color print mode wherein said motor drives only one toner cartridge, and adjusting motor control parameters for said motor in response to detecting said single-color print mode, so as to optimize the control of said motor for a reduced torque load in said single-color print mode.

6. The method of claim 5 wherein the speed of said motor is controlled by a motor control system including a PID controller, and wherein adjusting said motor control parameters comprises adjusting a parameter selected from the group consisting of proportional, integral, and derivative gains.

7. The method of claim 5 wherein detecting a single-color print mode comprises detecting that only one toner cartridge is inserted in said print mechanism.

8. The method of claim 7 wherein detecting that only one toner cartridge is inserted in said print mechanism comprises detecting that only one of a plurality of proximity sensors, each associated with one of said plurality of toner cartridges, indicates that only one toner cartridge is inserted in said print mechanism.

9. The method of claim 5 wherein detecting a single-color print mode comprises detecting that one toner cartridge has been removed from said print mechanism.

10. The method of claim 9 wherein detecting that one toner cartridge has been removed from said print mechanism comprises detecting that one of a plurality of proximity sensors, each associated with one of said plurality of toner cartridges, indicates that one toner cartridge has been removed from said print mechanism.

11. A motor controller for controlling a brushless DC motor in a multi-color electrophotographic print mechanism, said motor driving a plurality of toner cartridges, comprising:

an input indicating the instantaneous rotational position of said motor;

one input per toner cartridge driven indicating whether said cartridge is inserted in said print mechanism; and a control circuit operative to drive said motor in a plurality of modes in response to said toner cartridge inputs.

12. The controller of claim 11 wherein said control circuit changes modes by altering parameters of a control equation in response to said toner cartridge inputs.

13. The controller of claim 12 wherein said control circuit includes at least one PID controller.

14. The controller of claim 13 wherein said control equation parameters are predetermined gains selected from the group consisting of proportional, integral, and derivative gains.

15. The controller of claim 14 further comprising a memory operative to store said predetermined gains.

16. A method of driving a motor in an electrophotographic print mechanism, said motor driving at least one toner cartridge, comprising:

detecting a condition known to alter the torque load presented to said motor by said toner cartridge, and adjusting motor control parameters for said motor in response to detecting said condition, so as to optimize the control of said motor for an altered torque load.

17. The method of claim 16 wherein the speed of said motor is controlled by a motor control system including a PID controller, and wherein adjusting said motor control parameters comprises adjusting a parameter selected from the group consisting of proportional, integral, and derivative gains.

18. The method of claim 16 wherein said condition known to alter the torque load presented to said motor by said toner cartridge is selected from the group including toner cartridge life, amount of toner remaining, and toner temperature.

* * * * *